US006434861B1

(12) United States Patent
McCullough

(10) Patent No.: US 6,434,861 B1
(45) Date of Patent: Aug. 20, 2002

(54) APPARATUS FOR BACKFILLING

(76) Inventor: Charles E. McCullough, Box 367, Burkburnett, TX (US) 76354

( * ) Notice: Subject to any disclaimer, the term of this patent is extended or adjusted under 35 U.S.C. 154(b) by 0 days.

(21) Appl. No.: 09/704,909

(22) Filed: Nov. 2, 2000

Related U.S. Application Data

(60) Provisional application No. 60/163,279, filed on Nov. 3, 1999.

(51) Int. Cl.[7] ..... E02F 5/22
(52) U.S. Cl. ..... 37/142.5
(58) Field of Search ..... 37/142.5, 347, 37/363, 365; 111/189; 172/40, 675, 155, 158; 405/179, 271; 404/121, 122, 127

(56) References Cited

U.S. PATENT DOCUMENTS

| | | | | |
|---|---|---|---|---|
| 3,934,363 A | * | 1/1976 | McMurray | 37/142.5 |
| 4,109,336 A | | 8/1978 | Ford | |
| 4,283,867 A | * | 8/1981 | Brown | 37/142.5 |
| 4,295,531 A | | 10/1981 | Strickland | |
| 4,864,748 A | * | 9/1989 | Boyer | 37/142.5 |
| 4,912,862 A | * | 4/1990 | Bishop et al. | 37/142.5 |
| 4,933,853 A | | 6/1990 | Musil et al. | |
| 5,020,250 A | | 6/1991 | Fujii et al. | |
| 5,353,529 A | | 10/1994 | McCullough | |
| 5,479,728 A | * | 1/1996 | Deken et al. | 37/142.5 |
| 5,784,756 A | | 7/1998 | Slocum et al. | |
| 6,120,237 A | | 9/2000 | Cummings et al. | |

OTHER PUBLICATIONS ditchwitch.com website, 3700 home page, p. 1 of 1, (undated) printouts.
ditchwitch.com website, compact family, pp. 1 and 2, (undated) printouts.
toro.SiteWorks website, pp. 1, 2, and 3 (undated) printouts.

* cited by examiner

*Primary Examiner*—Robert E. Pezzuto
(74) *Attorney, Agent, or Firm*—Geoffrey A. Mantooth

(57) ABSTRACT

The accessory apparatus is used in conjunction with the vehicle for backfilling a trench. The accessory has a frame with first and second ends. Wheels are rotatably mounted to the first and second ends of the frame, with the wheels being structured and arranged to bear on ground beneath the frame. An auger is rotatably mounted to the ends of the frame. The auger has a shaft with flighting extending outward therefrom. The shaft is horizontal when the apparatus is in use. The auger has a height that is relative to the ground. A motor is coupled to one end of the frame, the motor causing the auger to rotate. A mounting bracket is pivotally coupled to the frame. The mounting bracket is structured and arranged to mount to the vehicle. As the frame pivots with respect to the mounting bracket, the height of the auger is raised or lowered relative to the ground. The mounting bracket can be pivotally coupled by a single set of pins, wherein a screw jack is used to pivot the frame relative to the mounting bracket. Alternatively, a four bar linkage can be used to couple the frame to the mounting bracket. If the vehicle can change the orientation of the mounting bracket relative to vertical, then the mounting bracket can be fixedly coupled to the frame.

12 Claims, 2 Drawing Sheets

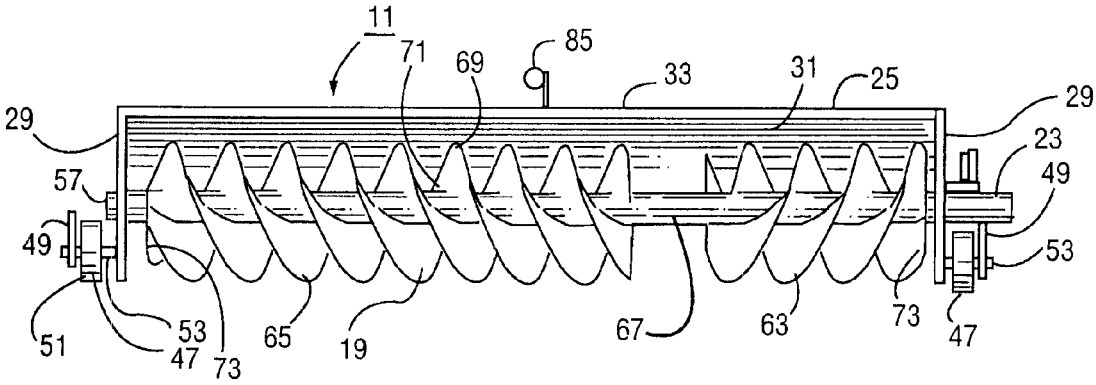
FIG. 1
FIG. 2
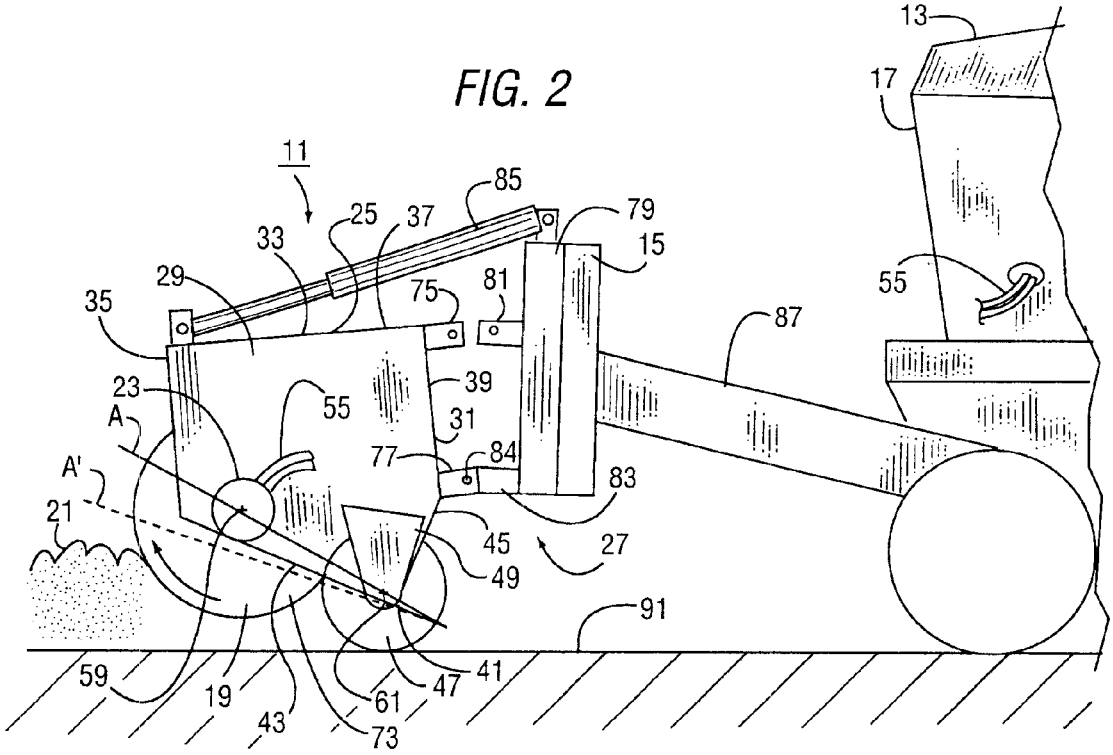

APPARATUS FOR BACKFILLING

This application is a continuation-in-part of application Ser. No. 60/163,279, filed Nov. 3, 1999.

FIELD OF THE INVENTION

The present invention relates to apparatuses for backfilling or covering up trenches, holes and the like with dirt.

BACKGROUND OF THE INVENTION

Trenches are dug for a variety of reasons. One example is to install piping into the ground for an irrigation or sprinkler system. The trench is dug with a trenching machine. The trenching machine removes dirt, forming the trench, and deposits the dirt at the side of the trench.

Once the pipe is laid in the trench, the trench must be filled in. Manually filling in the trench is laborious and time consuming. There is a need for a simple and inexpensive apparatus that would backfill a trench.

One such apparatus is shown in my U.S. Pat. No. 5,353,529. That apparatus has proved to be satisfactory. It is designed for small jobs. It would be desirable to have an apparatus for backfilling a trench for bigger jobs. Such a bigger job would entail moving more dirt into larger trenches.

SUMMARY OF THE INVENTION

It is an object of the present invention to provide an apparatus for backfilling trenches.

It is another object of the present invention to provide an inexpensive apparatus for backfilling trenches.

It is another object of the present invention to provide an apparatus for backfilling trenches that can be used as an implement on existing work vehicles.

The present invention provides an accessory apparatus for use in conjunction with a vehicle in backfilling a trench. The accessory apparatus has a frame with first and second ends. Wheels are rotatably mounted to the first and second ends of the frame. The wheels are structured and arranged to bear on ground beneath the frame. An auger is rotatably mounted to the first and second ends of the frame. The auger has a shaft with flighting extending radially outward therefrom. The shaft is oriented horizontally when the apparatus is used. The auger has a height relative to the ground. A motor is coupled to the frame and to the auger. The motor causes the auger to rotate. A mounting bracket is pivotally coupled to the frame. The mounting bracket is structured and arranged to mount to the vehicle, wherein the frame can move so as to adjust the height of the auger relative to the ground.

In accordance with one aspect of the present invention, the accessory apparatus further comprises a screw jack extending between the frame and the mounting bracket. The screw jack adjusts the height of the auger relative to the ground by pushing or pulling the frame relative to the mounting bracket.

In accordance with another aspect of the present invention, the motor is a hydraulic motor that is structured and arranged to be hydraulically coupled to the vehicle. The motor is located on one of the first or second ends.

In accordance with still another aspect of the present invention, the auger has a first portion of flighting, a second portion of flighting, and a center portion located between the first and second portions. The flighting on the first portion is in a first direction and the flighting on the second portion is in a direction that is opposite to the first direction.

In accordance with still another aspect of the present invention, the mounting bracket is pivotally coupled to the frame by at least one pin located adjacent to a bottom of the mounting bracket.

In accordance with still another aspect of the present invention, the mounting bracket can be fixedly coupled to the frame.

In accordance with still another aspect of the present invention, the mounting bracket can be coupled to the frame by way of a four bar linkage.

BRIEF DESCRIPTION OF THE DRAWINGS

FIG. 1 is a front elevational view of the apparatus of the present invention, in accordance with a preferred embodiment.

FIG. 2 is an end view of the apparatus of FIG. 1, shown mounted to the front end of a vehicle.

DESCRIPTION OF THE PREFERRED EMBODIMENT

Figure 3:
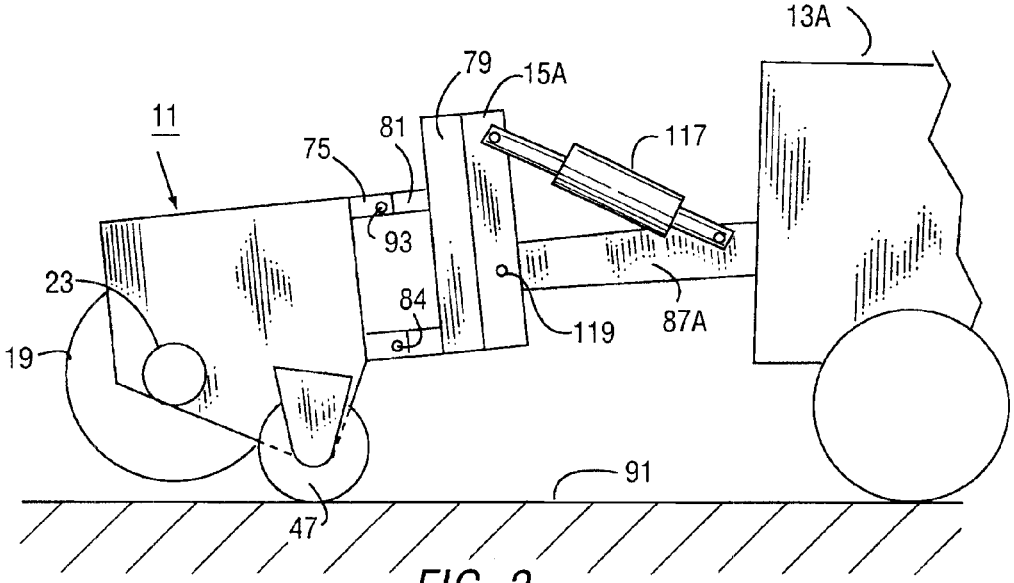
FIG. 3 is an end view of the apparatus of FIGS. 1 and 2, shown mounted to another vehicle.

In FIG. 1, there is shown an accessory apparatus 11 that is used to backfill trenches. The accessory apparatus is designed for use with a vehicle 13, as shown in FIG. 2.

The vehicle 13 can be of the self-propelled type, such as a trencher, or it can be a utility vehicle. The vehicle typically has suitable structure 15 on the front end 17 for mounting various attachments, such as a blade (not shown).

The accessory apparatus 11 is mounted to the front end 17 of the vehicle, and is thereby propelled by the vehicle. The accessory 11 has an auger 19 that is rotated. As the accessory is driven along and over a trench, the auger pushes the dirt 21 on the sides of the trench inwardly so as to fill in the trench.

The accessory 11 is self-contained in that the motor 33 for rotating the auger 19 is on the accessory itself. This simplifies the attachment of the accessory to the vehicle.

In addition, the accessory allows the height of the auger above the ground to be adjusted. This allows the auger to remove dirt overlying a grass lawn, without harming the grass.

The specifics of the accessory 11 will now be described. The accessory 11 includes a frame 25, the auger 19, the motor 23 and mounting structure 27.

The frame 25 includes two end plates 29. The end plates 29 are joined together by a back plate 31 and a top plate 33. The back and top plates 31, 33 are joined together along a common edge.

In the description that follows, the terms "front", "back", "top" and "bottom" are used with reference to the accessory being used in normal operation on the front end of a vehicle.

Each end plate 29 is generally rectangular in shape, at least along its front, top and back edges 35, 37, 39. The bottom of each end plate forms a comer 41, being formed by first and second edges 43, 45. The first and second edges 43, 45 are oriented about 90 degrees apart from each other and are inclined with respect to the front, top and bottom edges 35, 37, 39.

The front and bottom sides of the frame 25 are open so that the auger 19 can protrude therefrom.

Each end plate 29 has attached thereto a gauge wheel 47. In the preferred embodiment, the wheels 47 are coupled to the outside of the end plates 29. Wheel brackets 49 are provided to couple the wheels 47 to the end plates 29. Each wheel bracket 49 extends outwardly from the respective end plate and then downwardly so as to be parallel to the end plate. A cavity 51 is thus formed between the end plate 29 and the wheel bracket 49, which cavity receives one of the wheels 47. A bolt 53 serves as the axle and extends between the wheel bracket and the end plate. The wheel is located near the bottom comer 41 so that a portion of the wheel extends below the bottom comer. This allows the wheels to bear on the ground without interference from the end plates.

The auger 19 is located inside of the frame 25, extending between the end plates 29. The auger protrudes somewhat from the front and bottom sides of the frame 25. The auger is rotatably coupled to the end plates 29. At one end of the auger is the hydraulic motor 23. The motor 23 is coupled to the outside of the respective end plate 29. The motor 23 has two hydraulic lines 55, which are connected to a hydraulic pump (not shown) in the vehicle 13. The other end of the auger is mounted to the other end plate 29 by a bearing 57. In the preferred embodiment, the auger shaft is received by a slot in the end plate and the bearing is coupled to the outside of the respective end plate. When the accessory is located on a smooth, flat, level surface, the auger 19 is horizontal.

The auger has a rotational axis 59 which is the axis about which the auger rotates. In addition, both of the gauge wheels 47 rotate about a single rotational axis 61.

The rotational axis of the auger is offset from the rotational axis of the gauge wheels. As shown in FIG. 2, the rotational axis 59 of the auger is forward of and above the rotational axis 61 and the gauge wheels. The outside diameter of the auger, as measured to the outer end of the flighting 69, is larger than the outside diameter of the gauge wheels 47.

Referring to FIG. 1, the auger 19 has first and second portions 63, 65. The first portion 63 extends from a first end of the auger to a center portion 67, while the second portion 65 extends from a second end of the auger to the center portion. In the preferred embodiment, the second portion 65 is longer than the first portion 63 because many types of trenching machines throw the dirt primarily on one side of the trench when digging. The second portion is located on this particular side of the trench.

Each auger portion has flighting 69 for removing dirt from the ends to the center portion. The flighting 69 is welded to a shaft 71. Each auger portion has several rows of flighting. In the preferred embodiment, each auger portion has three rows of flighting, with the rows separated by about 120 degrees on the shaft. This triple row of flighting allows the auger to move more dirt and go faster than conventional augers. Each row of flighting is formed by a solid vane that extends radially outward from the shaft. The vanes spiral around the circumference of the shaft from the respective end to the center portion. There is a circular end plate 73 at the end of each of the first and second ends. The ends of the flighting are welded to the end plates 73. Thus, the end plates 73 rotate in unison with the flighting. The flighting on the first auger portion 63 is oriented in the opposite direction from the flighting on the second auger portion 65. All of the flighting is oriented so that as the auger is rotated, dirt is moved from the ends to the center.

The auger can be of a different configuration than shown in FIG. 1. For example, the first and second portions can be of equal length, wherein the center portion is truly centered along the auger. Alternatively, the auger can have just a first portion, without a center portion and a second portion, or a second portion, without a center portion and a first portion.

The mounting structure 27 is used to mount the accessory to the vehicle 13. The back plate 31 has upper and lower mounting brackets 75, 77 extending rearwardly therefrom. Each mounting bracket is a short tab with an opening therethrough. There is an upper mounting bracket 75 and a lower mounting bracket 77 at each end of the frame 25.

A mounting plate 79 is provided rearwardly of the frame. The mounting plate 79 has similar upper and lower mounting brackets 81, 83 extending forwardly therefrom. The lower mounting brackets 77, 83 are pivotally coupled together by a bottom pin 84. The upper mounting brackets 75, 81 are not coupled to each other in one embodiment, as shown in FIG. 2.

The mounting plate 79 extends upwardly above the mounting plate upper mounting brackets 81 for a short distance. The upper end of the mounting plate is coupled to the top plate 33 of the frame by a screw jack 85. A handle (not shown) is connected to the screw jack 85. Rotating the handle in one direction causes the screw jack to elongate, while rotating the handle in the opposite direction causes the screw jack to shorten.

In the embodiment shown in FIG. 2, the accessory apparatus 11 is mounted to a trencher type of vehicle 13. Such a vehicle 13 has arms 87 extending from its front end. Coupled to the arms is a mounting plate 15. To install the accessory 11 on the vehicle 13, the two mounting plates 79, 15 are bolted together. Appropriate holes for receiving the bolts are provided in the respective mounting plates. The hydraulic motor lines 55 are connected to hydraulic ports of a pump on the vehicle 13. The accessory 11 is now installed onto the vehicle 13.

The operation of the accessory 11 will now be described. The auger 19 is rotated by operating the hydraulic pump on the vehicle, which in turn operates the motor 23. The auger is rotated in a direction that will move dirt to the center portion 67. In FIG. 2, the auger rotates clockwise. The dirt is moved forward and swept in toward the trench.

The vehicle 13 is driven forward so that the center portion 67 of the auger 19 is over the trench and the auger flighting 69 contacts the dirt 21 that is adjacent to the trench. The rotating auger moves the dirt towards the center portion and into the trench.

The top plate 33 of the accessory 11 can have a mark over the center portion 67. The driver of the vehicle simply steers so as to maintain the mark over the trench. The accessory is moved along the length of the trench by the vehicle, moving dirt in to fill the trench.

The height of the auger 19 above the ground 91 can be adjusted so as to conform to a variety of conditions and ground contours. In addition, the height of the auger can be adjusted to avoid injuring any turf grass that is beneath the dirt. This is accomplished by pivoting the auger 19 (and the guide wheels) about the bottom pin 84. For the description the follows, reference is made in FIG. 2 to an imaginary line A extending through the rotational axes 59, 61 of the auger 19 and the gauge wheels 47. Referring to the orientation of FIG. 2, pivoting the accessory 11 down about the bottom pin 84 causes the auger 19 to drop down. The angle that the imaginary line A' (shown in dashed lines) makes with the ground 91 thus decreases, wherein the auger is effectively lowered. To pivot the auger down, the gauge wheels 47 may have to be lifted off of the ground. Pivoting the accessory up causes the auger to move up. The angle that the imaginary line A makes with the ground thus increases, wherein the auger is effectively raised above the ground 91.

The auger of FIG. 2 is raised and lowered with the screw jack 85. When the screw jack 85 is lengthened, it pushes against the mounting plates 79, 15 and pivots the auger down, thus effectively lowering the auger. The mounting plate remains relatively motionless as it is fixed to the vehicle. When the screw jack 85 is shortened, it pulls the auger up, thus effectively raising the auger.

Thus, if the auger is operating over short grass, the height of the auger can be lowered to sweep relatively more dirt off of the grass and into the trench. If the auger is operating over tall grass, or the terrain is bumpy, then the height of the auger is raised to minimize any damage that the rotating auger could inflict on the grass.

With the vehicle 13 shown in FIG. 2, the mounting plate 15 can be moved up and down by the vehicle. However, the vehicle is unable to vary the orientation of the mounting plate with respect to the ground.

With the vehicle 13A shown in FIG. 3, the orientation of the mounting plate 1 SA with respect to the ground can be changed. Such a vehicle can be a skid steer loader that not only raises and lowers the front end accessory, but rotates the mounting plate 15A to become more or less vertical. The screw jack is not needed for such a vehicle. Instead, the upper brackets 75, 81 are coupled together by an upper pin 93. The height of the auger 19 is adjusted by rotating the mounting plate 15A relative to a vertical position. The vehicle 13A has a hydraulic cylinder 117 pivotally connected between the arm 87A and the mounting plate. The hydraulic cylinder is connected to the hydraulic pump on the vehicle. The operator activates the cylinder 117, which pivots the mounting plate 15A about a pivot point 119. When the proper height is achieved, the accessory 11 can be lowered to the ground, wherein the gauge wheels 47 bear on the ground 91.

Figure 4:
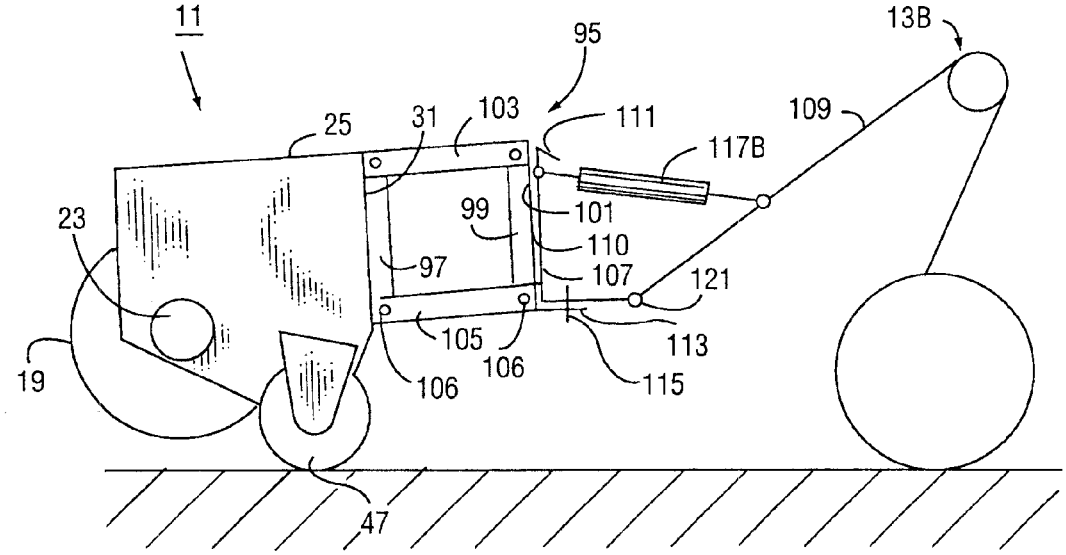
FIG. 4 is an end view of the apparatus, in accordance with another embodiment, mounted to still another vehicle.

FIG. 4 shows another mounting arrangement of the accessory. The vehicle 13B is a utility vehicle (shown schematically) capable of receiving a number of accessories at its front end. The mounting arrangement includes a four bar linkage 95 located adjacent at each end of the accessory. Each four bar linkage has a first bar 97 coupled to the back plate 31 of the frame 25, a second bar 99 coupled to a mounting fixture 101, a third bar 103 extending between the top ends of the first and second bars 97, 99 and a fourth bar 105 extending between the bottom ends of the first and second bars 97, 99. The bars 97, 99, 103, 105 are pivotally coupled together by pins 106. The mounting fixture 101 is conventional and commercially available, being adapted to be coupled to a bracket 107 that is attached to an articulated arm 109 on the vehicle 13B. The mounting fixture 101 has a plate 110. The plate 110 has a rearwardly facing upper lip 111 and a bottom shelf 113. The upper lip 111 is inclined downwardly. The bracket 107 is "L" shaped and fits in underneath the lip. Spring loaded pins 115 couple the bottom end of the bracket to the mounting fixture.

The articulated arm 109 can raise and lower the mounting fixture 101, as well as change the orientation with respect to the vertical. A cylinder 117B is provided to pivot the bracket 107 about a pivot point 121. Any change with respect to the vertical of the mounting fixture 101 is followed by the first bar 97 and thus the accessory 11, due to the four bar linkage 95. To lower the auger, the cylinder 117B rotates the mounting bracket forward, wherein the upper edge is moved forward of the lower edge. To raise the auger, the cylinder 117B rotates the mounting bracket rearwardly.

Thus, the present invention provides an accessory that can be mounted onto a variety of vehicles and the height of the auger relative to the gauge wheels can be adjusted.

The foregoing disclosure and the showings made in the drawings are merely illustrative of the principles of this invention and are not to be interpreted in a limiting sense.

What is claimed is:

1. An accessory apparatus for use in conjunction with a vehicle in backfilling a trench, comprising:

a) a frame having first and second ends;

b) wheels rotatably mounted to the first and second ends of the frame, the wheels being structured and arranged to bear on ground beneath the frame;

c) an auger rotatably mounted to the first and second ends of the frame, the auger having a shaft with flighting extending radially outward therefrom, the shaft being oriented horizontally when the apparatus is in use and the auger having a height relative to the ground;

d) a motor coupled to the frame and to the auger, the motor causing the auger to rotate;

e) a mounting bracket pivotally coupled to the frame, the mounting bracket being structured and arranged to removably mount to the vehicle, wherein the frame can move so as to adjust the height of the auger relative to the ground.

2. The accessory apparatus of claim 1 further comprising a screw jack extending between the frame and the mounting bracket, the screw jack adjusting the height of the auger relative to the ground.

3. The accessory apparatus of claim 1 wherein the motor is a hydraulic motor that is structured and arranged to be hydraulically coupled to the vehicle.

4. The accessory apparatus of claim 3 wherein the motor is located on one of the first or second ends.

5. The accessory apparatus of claim 1 wherein the auger has a first portion of flighting, a second portion of flighting, and a center portion located between the first and second portions, the flighting on the first portion being in a first direction and the flighting on the second portion being in a direction that is opposite to the first direction.

6. The accessory apparatus of claim 1 wherein the mounting bracket is pivotally coupled to the frame by at least one pin located adjacent to a bottom of the mounting bracket.

7. The accessory apparatus of claim 1 wherein the mounting bracket can be fixedly coupled to the frame.

8. The accessory apparatus of claim 1 wherein the mounting bracket is coupled to the frame by way of a four bar linkage.

9. The accessory apparatus of claim 1 further comprising:

a) a screw jack extending between the frame and the mounting bracket, the screw jack adjusting the height of the auger relative to the ground;

b) the motor is a hydraulic motor that is structured and arranged to be hydraulically coupled to the vehicle, the motor is located on one of the first or second ends;

c) the auger has a first portion of flighting, a second portion of flighting and a center portion located between the first and second portions, the flighting on the first portion being in a first direction and the flighting on the second portion being in a direction that is opposite to the first direction.

10. The mounting apparatus of claim 1 wherein the mounting bracket comprises a plate.

11. The mounting apparatus of claim 1 wherein the mounting bracket comprises a removable retainer to allow the mounting bracket to either be pivotally coupled to the frame when the retainer is removed and to allow the mounting bracket to be fixedly coupled to the frame when the retainer is in place.

12. An apparatus for backfilling a trench, comprising:

a) a vehicle;

b) a frame having first and second ends;

c) wheels rotatably mounted to the first and second ends of the frame, the wheels being structured and arranged to bear on ground beneath the frame;

d) an auger rotatably mounted to the first and second ends of the frame, the auger having a shaft with flighting extending radially outward therefrom, the shaft being oriented horizontally when the apparatus is in use and the auger having a height relative to the ground;

e) a motor coupled to the frame and to the auger, the motor causing the auger to rotate;

f) a mounting bracket pivotally coupled to the frame, the mounting bracket being removably coupled to the vehicle, wherein the frame can move so as to adjust the height of the auger relative to the ground.

* * * * *